United States Patent [19]

Lüttgert et al.

[11] 3,953,698

[45] Apr. 27, 1976

[54] CONTACT SYSTEM FOR A VACUUM SWITCH

[75] Inventors: Hans Lüttgert, Berlin; Werner Kohler, Bentfeld, Holstein, both of Germany

[73] Assignee: Siemens Aktiengesellschaft, Munich, Germany

[22] Filed: Sept. 26, 1974

[21] Appl. No.: 509,725

[30] Foreign Application Priority Data

Sept. 28, 1973 Germany ..... 2349569

[52] U.S. Cl. ..... 200/279; 200/144 B

[51] Int. Cl.[2] ..... H01H 1/06

[58] Field of Search ..... 200/279, 144 B

[56] References Cited

UNITED STATES PATENTS

| | | | |
|---|---|---|---|
| 2,678,983 | 5/1954 | Strom | 200/279 X |
| 3,089,936 | 5/1963 | Smith, Jr. | 200/279 X |
| 3,182,156 | 5/1965 | Lee et al. | 200/279 X |

FOREIGN PATENTS OR APPLICATIONS

| | | | |
|---|---|---|---|
| 331,929 | 11/1919 | Germany | 200/279 |
| 1,262,406 | 3/1968 | Germany | 200/144 B |

*Primary Examiner*—Herman Hohauser
*Attorney, Agent, or Firm*—Kenyon & Kenyon Reilly Carr & Chapin

[57] ABSTRACT

A contact system for a vacuum switch includes contact members movable relative to each other for electrically opening and closing the vacuum switch. Each of the contact members includes a carrier and a contact piece mounted on the carrier. Openings are formed in at least one of the contact pieces along substantially concentric circular arcs so that the openings of one series cover the gaps between the openings of an adjacent series.

5 Claims, 5 Drawing Figures

CONTACT SYSTEM FOR A VACUUM SWITCH

BACKGROUND OF THE INVENTION

The invention relates to a vacuum switch having contact pieces movable relative to one another and fastened on supports. The contact pieces are provided with elongated openings to guide the electric arc foot-points.

Switches of this kind are known from U.S. Pat. No. 3,158,719. The known contact pieces have a middle region serving as a permanent contact, and surrounding this and serving for the progress of the electric arc, a part is provided with spiral slits extending from the middle contact part to the rim of the contact piece.

SUMMARY OF THE INVENTION

Many problems related to the mechanics and material arise in the production of the above-mentioned contact pieces. Accordingly, it is an object of the invention to eliminate these problems.

The contact system according to the invention is suitable for a vacuum switch and includes contact members movable relative to each other for electrically opening and closing the vacuum switch. According to a feature of the invention, opening means are formed in at least one of the contact pieces for guiding the arc drawn when the contact pieces are separated from each other. The opening means can be in the form of a plurality of arc-like openings formed in the one contact piece. The arc-like openings can be grouped into at least two sets. The first set of arc-like openings can be arranged in a row along a first circular arc so that each two mutually adjacent ones of the arc-like openings conjointly define a space therebetween. The second set of arc-like openings can be arranged in a row along a second circular arc substantially concentric to the first circular arc. The second set of arc-like openings is arranged so that each two mutually adjacent ones of the same conjointly define a space therebetween. The arc-like openings of the first and second sets are situated along the circular arcs so as to cause each one of the arc-like openings to be adjacent and extend beyond a corresponding one of the spaces in the adjacent circular arc.

Although with this arrangement of openings, no continuous path from the middle to the rim of a contact piece exists for the electric arc foot-points, nevertheless the arcs are positively conducted tangentially outward as a consequence of which the desired lengthening of the arc is obtained. There is a considerable facilitation in the production of this contact piece in that the openings are situated on circular arcs, and therefore can be produced with relatively simple tools and processing machines. Furthermore, the invention affords a contact system which is compact and of increased mechanical strength.

The contact system according to the invention has in its simplest form of construction two concentric series, each having two openings whereby the openings of the one series cover the gaps between the openings of the other series. The desired way of working can however also be obtained when for example each of the two series has three openings or when more than two series are provided with a desired number of openings which cover the gaps between the openings of the other series in the described way.

Under certain conditions satisfactory results are obtained with contact pieces which have plane contact surfaces. It may however be advantageous to use for the contact pieces of vacuum switches the known frustoconical form, with which only the middle part serves for the permanent contact. In this case the openings may be disposed on the conical surface.

As already mentioned, a substantial advantage of the contact pieces of the contact system according to the invention lies in their closed form which is not interrupted by slits, channels or other openings. It is furthermore also possible to make the openings in the form of through extending slits. A good operation is obtained also when the openings are made as grooves whereby it may be advantageous to situate the grooves in a layer of arc resistant contact material; this layer, in turn, is connected with another layer of good-conducting material. In this case the part provided with openings or grooves and exposed to the electric arc may consist of a copper-chromium alloy; while the part of the piece turned away from the arc may be made of copper.

In association with the frustoconical contact pieces and according to another embodiment of the invention, the supply of current thereto may be directed to the region of the gaps between the openings of the outer row. This ensures that the arcs are prevented from leaving the space between the contact pieces. Also tangential deviation of the arc foot-points, that is, the movement of the arc is promoted by this form of current guidance.

Although the invention is illustrated and described herein as a contact system for a vacuum switch, it is nevertheless not intended to be limited to the details shown, since various modifications may be made therein within the scope and the range of the claims. The invention, however, together with additional objects and advantages will be best understood from the following description and in connection with the accompanying drawings.

DESCRIPTION OF THE PREFERRED EMBODIMENTS OF THE INVENTION

Figure 1:
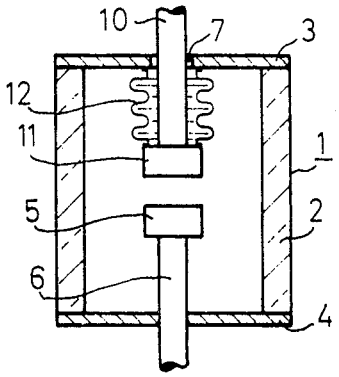
FIG. 1 is a schematic diagram, partially in section, of a vacuum switch equipped with a contact system according to the invention. Vacuum switches so equipped are particularly suited for medium voltage equipment.

The vacuum switch vessel 1 of FIG. 1 has a housing 2 made of a suitable insulating material such as glass or porcelain. At its end faces, the housing 2 is closed by an upper end cap 3 and a lower end cap 4, whereat use is made of processes suitable for connecting the ceramic and metal parts; or, use may be made of suitable bonding processes. Inside the housing 2 is disposed a stationary contact piece 5 fastened to a support 6 which extends through the end cap 4 in a vacuum tight manner and which may serve at the same time to produce an electric connection and to hold the switch vessel in a switching apparatus. In an opening 7 in the upper end cap 3 is guided the carrier 10 of a movable contact piece 11 which is sealed off from the surrounding atmosphere by a pleated bellows 12. This bellows 12 permits the stroke of the movable contact piece 11 required for the opening and closing switching operation. For simplification, other parts usually associated with vacuum switches such as a screen surrounding the contact pieces and devices for operating them, e.g., an electromagnetic drive, are not shown.

The contact pieces 5 and 11 are substantially in the form of cylindrical discs wherein are disposed concentric elongated openings 13 and 14. Two elongated openings 13 are disposed on an outer circle, and two also elongated openings 14 are disposed on an inner circle. The openings 13 and 14 are staggered 90°, that is, when viewed in a radial direction the openings 14 cover the spaces between the openings 13 and vice versa.

Figure 2:
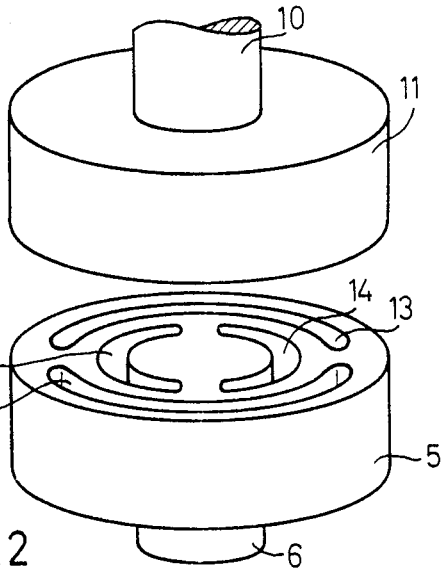
FIG. 2 is an isometric representation of the contact system according to the invention.
Figure 3:
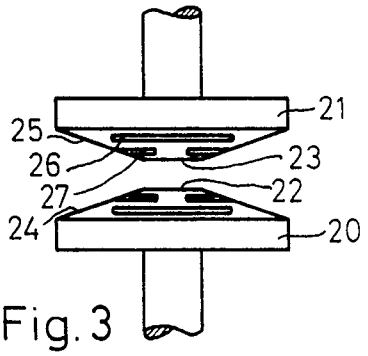
FIG. 3 is an elevation view of an alternate embodiment of the contact system according to the invention wherein the contact pieces each include a frustoconical portion.

In the embodiment of FIG. 3, the contact pieces 20 and 21 are of frustoconical form. The center plane faces 22 and 23 of pieces 20 and 21, respectively, are seated against one another when the switch vessel is in the closed position and transmit the operative current of the switch vessel. The outer peripheral surfaces 24 and 25 serve to conduct and spread out the electric arc that is drawn after the separation of the contact pieces. In these conical surfaces are openings 26 and 27 which can be arranged in a manner similar to that shown in FIG. 2.

Figure 4:
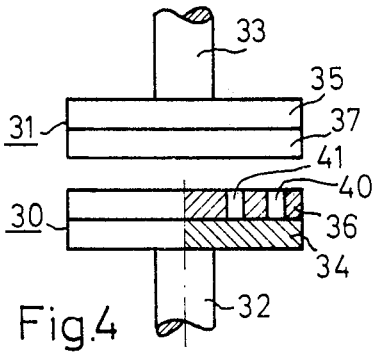
FIG. 4 illustrates an embodiment of the contact system wherein the openings formed in the contact pieces extend only part way therethrough.

With the embodiments of FIGS. 2 and 3, openings 13, 14 and 26, 27 extend through the entire axial distance of the contact pieces. It may however suffice, as shown in FIG. 4, if the openings are in the form of grooves which extend over only a portion of the axial thickness of the contact pieces. In this embodiment, the contact pieces 30 and 31 each consist of two layers. The layers 34, 35 are configured as discs and are connected with the carriers 32, 33 respectively. The discs 34, 35 consist of a material which is a good conductor such as copper, and the other layers in the form of further discs 36, 37 are made of a material able to withstand electric arcs, for example, a copper-chromium alloy. In the discs 36 and 37, the openings are machined out in the form of slits 40 and 41 whose arrangement may again be made similar to that shown in FIG. 1. It should however be mentioned that even in this embodiment, there may be provided a greater number of openings; that is, more than two rows of openings, can be provided. Also, more than two openings with spaces therebetween can be disposed on one circle.

For producing the openings or grooves, the known chipremoving processes are suitable. They may however also be produced through punching as well as through forging. By means of drop forging, a complete contact piece equipped with openings can be produced in a single work operation.

Figure 5:
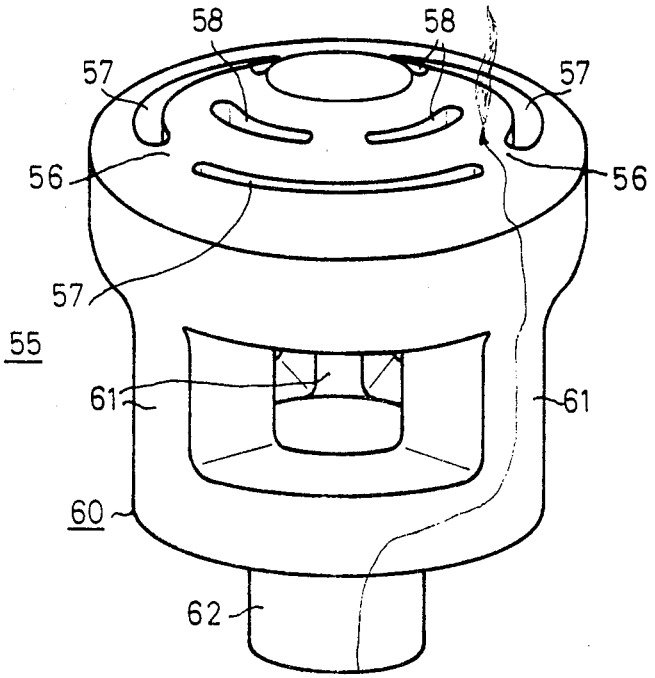
FIG. 5 illustrates a subsidiary embodiment of the contact system according to the invention wherein means are provided for directing current to the spaces between mutually adjacent openings in the outer row of openings.

The embodiment of FIG. 5 provides a special way of getting current through the contact piece and this is achieved by incorporating a frustoconical element 55 which resembles that of FIG. 3. There are two rows each having three openings 57 and three openings 58, respectively, that extend all the way through. Here the element 55 sits on current directing means in the form of a three-armed intermediate piece 60 having arms 61 connected with the contact piece 55 in the region of the spaces 56 between the openings 57. Preferably, the contact piece 55 and the intermediate part 60 may be made as one piece which is produced as a forging. There is suitably connected to the intermediate piece 60 a carrier pin 62.

Supplying the current in the region of the spaces 56 has the result that a current loop is formed which exerts on the arc a force directed to the middle of the contact piece when the arc approaches the rim of the contact piece; this prevents an emergence of the arc out of the space between the contact pieces. Together with the openings 57 and 58, the described current supply also promotes the tangential deviation of the arc base and thereby the motion of the arc.

In the described embodiments, the openings run exactly along concentric circles. Within the scope of the invention it is however not necessary to keep exactly to this concentric arrangement, and it may also be advantageous to impart to the openings a certain inclination relative to the circles; that is, to a certain extent, the openings may be spirally situated. In all cases, it is essential that the openings and the spaces between openings are covered as described above.

What is claimed is:

1. A contact system for a vacuum switch comprising contact members movable relative to each other for electrically opening and closing the vacuum switch, each of the contact members including a carrier and a contact piece mounted on said carrier, and opening means formed in at least one of the contact pieces for guiding the arc drawn when the contact pieces are separated from each other, said opening means being a plurality of arc-like openings formed in said one contact piece, said arc-like openings being grouped into at least two sets, the first set of arc-like openings being arranged in a row along a first circular arc so that each two mutually adjacent ones of said arc-like openings conjointly define a space therebetween, and the second set of arc-like openings being arranged in a row along a second circular arc substantially concentric to said first circular arc, said second set of arc-like openings being arranged so that each two mutually adjacent ones of the same conjointly define a space therebetween, said arc-like openings of said first and second sets being situated along said circular arcs so as to cause each one of said arc-like openings to be adjacent and extend beyond a corresponding one of said spaces in the adjacent circular arc.

2. The contact system of claim 1, said arc-like openings extending through the entire axial length of said contact piece.

3. The contact system of claim 1, said one contact piece having the shape of a conical frustrum, said openings being formed in the conical surface of said conical frustrum.

4. The contact system of claim 2 comprising current directing means for directing the flow of current to said contact piece at the spaces thereof formed between mutually adjacent ones of the openings arranged along the outermost one of said circular arcs.

5. The contact system of claim 1, said one contact piece including a layer of arc-resistant contact material formed on the outer surface thereof, said openings being located only in said layer.

* * * * *